US010391667B2

(12) United States Patent
Staeubli et al.

(10) Patent No.: US 10,391,667 B2
(45) Date of Patent: Aug. 27, 2019

(54) PORTABLE POWER TOOL

(71) Applicant: Robert Bosch GmbH, Stuttgart (DE)

(72) Inventors: Tom Staeubli, Zürich (CH); Robert Simm, Oekingen (CH); Thomas Bannwart, Wiedlisbach (CH); Nico Spinelli, Zürich (CH)

(73) Assignee: Robert Bosch GmbH, Stuttgart (DE)

( * ) Notice: Subject to any disclaimer, the term of this patent is extended or adjusted under 35 U.S.C. 154(b) by 121 days.

(21) Appl. No.: 15/321,076

(22) PCT Filed: May 4, 2015

(86) PCT No.: PCT/EP2015/059658
§ 371 (c)(1),
(2) Date: Dec. 21, 2016

(87) PCT Pub. No.: WO2015/197240
PCT Pub. Date: Dec. 30, 2015

(65) Prior Publication Data

US 2017/0144325 A1 May 25, 2017

(30) Foreign Application Priority Data

Jun. 25, 2014 (DE) ..... 10 2014 212 158

(51) Int. Cl.
*B27C 1/10* (2006.01)

(52) U.S. Cl.
CPC ..... *B27C 1/10* (2013.01)

(58) Field of Classification Search
CPC ..... B27C 1/10
See application file for complete search history.

(56) References Cited

U.S. PATENT DOCUMENTS 1,706,157 A 3/1929 Hannah
1,980,056 A * 11/1934 Hedeby ..... B27C 1/10 30/475
2,894,549 A * 7/1959 Garland ..... B27C 1/10 30/475

(Continued)

FOREIGN PATENT DOCUMENTS

CN 1911609 A 2/2007
CN 1972788 A 5/2007

(Continued)

OTHER PUBLICATIONS

International Search Report corresponding to PCT Application No. PCT/EP2015/059658, dated Sep. 2, 2015 (German and English language document) (5 pages).

*Primary Examiner* — Hwei-Siu C Payer
(74) *Attorney, Agent, or Firm* — Maginot, Moore & Beck LLP

(57) ABSTRACT

A portable power tool, in particular a hand-held planing machine, includes at least one workpiece contact unit and at least one handle unit. The workpiece contact unit has at least one workpiece contact surface, and the handle unit has at least one main handle. The main handle has at least one maximum distance point that, in a direction extending at least substantially perpendicularly to a workpiece contact surface, has a maximum distance from the at least one workpiece contact surface. The maximum distance is less than 150 mm.

19 Claims, 3 Drawing Sheets

(56) References Cited

U.S. PATENT DOCUMENTS 4,920,651 A * 5/1990 Schmidt ..... B27C 1/10 30/475
5,022,160 A * 6/1991 Sharpe ..... B27C 1/10 144/225
5,024,000 A * 6/1991 Casal ..... B27C 1/10 30/475
5,463,816 A 11/1995 Bellew et al.
5,856,715 A * 1/1999 Peot ..... B23D 45/16 30/388
7,549,450 B2 * 6/2009 Thomas ..... B23Q 11/005 144/136.95
8,136,559 B2 * 3/2012 Rosenau ..... B27C 1/10 144/154.5
8,752,645 B2 * 6/2014 Liebhard ..... H04Q 9/00 173/1
9,259,831 B2 * 2/2016 Boeck ..... B24B 23/028
2005/0284543 A1 * 12/2005 Kaiser ..... B27C 1/10 144/373
2006/0207683 A1 * 9/2006 Park ..... B23Q 11/005 144/136.95
2008/0003505 A1 * 1/2008 Wuensch ..... B25F 5/02 429/303
2009/0293991 A1 * 12/2009 Rosenau ..... B25F 5/006 144/117.4
2011/0171887 A1 * 7/2011 Tanimoto ..... B24B 23/028 451/359
2015/0183125 A1 * 7/2015 Kumakura ..... B27C 1/10 30/475
2017/0129129 A1 * 5/2017 Simm ..... B25F 5/003
2017/0144325 A1 * 5/2017 Staeubli ..... B27C 1/10

FOREIGN PATENT DOCUMENTS

DE 1 994 146 U 9/1968
DE 36 06 830 A1 9/1987
DE 198 53 374 A1 5/2000
DE 10 2005 005 553 A1 8/2006
EP 1 428 639 A1 6/2004
GB 2 449 551 A 11/2008
JP H0550402 A 3/1993
JP 8-118310 A 5/1996
WO 2004/076140 A1 9/2004
WO 2007/093821 A1 8/2007

* cited by examiner

PORTABLE POWER TOOL

This application is a 35 U.S.C. § 371 National Stage Application of PCT/EP2015/059658, filed on May 4, 2015, which claims the benefit of priority to Serial No. DE 10 2014 212 158.2, filed on Jun. 25, 2014 in Germany, the disclosures of which are incorporated herein by reference in their entirety.

BACKGROUND

Already known from DE 198 53 374 B4 is a portable power tool, in particular a hand-held power planer, having a workpiece contact unit that has a workpiece contact surface, and having a handle unit that has a main handle.

SUMMARY

This disclosure is based on a portable power tool, in particular a hand-held power planer, having at least one workpiece contact unit that has at least one workpiece contact surface, and having at least one handle unit that has at least one main handle.

It is proposed that the main handle have at least one maximum distance point that, as viewed along a direction that is at least substantially perpendicular to the at least one workpiece contact surface, has a maximum distance of less than 150 mm in relation to the at least one workpiece contact surface. The expression "substantially perpendicular" is intended here to define an alignment of a direction relative to a reference direction, the direction and the relative direction, in particular as viewed in one plane, enclosing an angle of 90° and the angle having a maximum deviation of, in particular, less than 8°, advantageously less than 5°, and particularly advantageously less than 2°. A "maximum distance point of the main handle" is to be understood here to mean, in particular, a point located on the main handle that, as viewed along the direction that is at least substantially perpendicular to the workpiece contact surface, has the greatest distance in relation to the workpiece contact surface, in comparison with further points located on the main handle. Particularly preferably, the maximum distance point is disposed on a hand contact surface, in particular on a contact surface of a hand inner surface, of the main handle. The maximum distance point is thus preferably disposed on a side of the main handle that faces away from the workpiece contact surface. A "main handle" is to be understood here to mean, in particular, a handle that, in the case of proper handling of the portable power tool, can be used for guiding the portable power tool and on which most of a guiding force by an operator for guiding the portable power tool can be supported. Particularly preferably, an operating unit, in particular at least one movably mounted operating element of the operating unit, for putting the portable power tool into operation, is disposed on the main handle. The operating unit can thus preferably be operated by an operator when gripping the main handle. The main handle is preferably realized as a bow-type handle. The main handle is thus connected, by two ends of the main handle that face away from one another, to a power tool housing of the portable power tool, in particular is realized so as to be integral with the power tool housing. Preferably, the main handle has an oval cross-sectional shape, with flattened sides. It is also conceivable, however, for the main handle to have an elliptical cross-sectional shape, a round cross-sectional shape, or other cross-sectional shape considered appropriate by persons skilled in the art. An "operating unit" is to be understood to mean, in particular, a unit having at least one component that can be actuated directly by an operator, and which is designed to influence and/or change a process and/or a state of a unit coupled to the operating unit as a result of an actuation and/or an input of parameters. "Designed" is to be understood to mean, in particular, specially configured and/or specially equipped. That an element and/or a unit are/is designed for a particular function is to be understood to mean, in particular, that the element and/or the unit fulfill/fulfills and/or execute/executes this particular function in at least one application state and/or operating state.

A "portable power tool" is to be understood here to mean, in particular, a power tool, for performing work on workpieces, that can be transported by an operator without the use of a transport machine. The portable power tool has, in particular, a mass of less than 40 kg, preferably less than 10 kg, and particularly preferably less than 5 kg. Particularly preferably, the portable power tool is realized as a hand-held power planer. It is also conceivable, however, for the portable power tool to be of a different design, considered appropriate by persons skilled in the art, such as, for example, designed as a power jig saw, as a power router, or the like.

The term "workpiece contact unit" is intended here to define, in particular, a unit of the portable power tool that, while work is being performed on a workpiece by means of the portable power tool, the portable power tool being handled in a proper manner, is in contact with and/or lies on the workpiece, in particular by the at least one workpiece contact surface of the workpiece contact unit, and that is designed to support the portable power tool on the workpiece while work is being performed on the workpiece. Particularly preferably, the workpiece contact unit is realized as a foot plate, as a slide shoe and/or as a base plate. Preferably, while work is being performed on a workpiece, the portable power tool slides by means of the workpiece contact unit, in particular by the at least one workpiece contact surface of the workpiece contact unit, on a surface of the workpiece on which work is to be performed.

Advantageously, the portable power tool has a maximum longitudinal extent and a maximum height extent, a ratio of the maximum longitudinal extent to the maximum height extent being less than 2.5. Preferably, the ratio of the maximum longitudinal extent to the maximum height extent is less than 2.4. Particularly preferably, the maximum longitudinal extent is at least substantially parallel to the at least one workpiece contact surface, and at least substantially perpendicular to a movement axis, in particular a rotation axis, of an insert tool unit of the portable power tool. Preferably, in the case of the portable power tool being designed as a power tool operated via a power cord, the maximum longitudinal extent is less than 350 mm, preferably less than 320 mm, and particularly preferably less than 300 mm. In particular, in the case of the portable power tool being designed as a battery-operated portable power tool, the maximum longitudinal extent is less than 280 mm, preferably less than 250 mm, and particularly preferably less than 220 mm. In this case, preferably, a movably mounted workpiece contact surface of the workpiece contact unit has, in particular, a maximum longitudinal extent of less than 100 mm, preferably less than 80 mm, and particularly preferably less then 70 mm. A workpiece contact surface of the workpiece contact unit that is fixed relative to the power tool housing has, in particular, a maximum longitudinal extent of less then 150 mm, preferably less than 130 mm, and particularly preferably less than 120 mm. Further, the maximum height extent is preferably at least substantially perpendicular to the at least one workpiece contact surface. Particularly preferably, the maximum height extent is constituted by the maximum distance of the maximum distance point in relation to the workpiece contact surface. In particular, the maximum height extent is less than 180 mm, preferably less than 150 mm, and particularly preferably less than 140 mm. Further, the portable power tool preferably comprises a maximum width extent, which is at least substantially parallel to the at least one workpiece contact surface, and at least substantially parallel to the movement axis, in particular the rotation axis, of the insert tool unit of the portable power tool. In particular, the maximum width extent is less than 140 mm, preferably less than 120 mm, and particularly preferably less than 100 mm. In a very particularly preferred design of the portable power tool, the maximum width extent is preferably less than 60 mm. Preferably, in particular, a ratio of the maximum longitudinal extent to the maximum width extent is less than 2.5, preferably less than 2.4, and particularly preferably less than 2.3.

By means of the design according to the disclosure, the main handle is preferably disposed close to the at least one workpiece contact surface. It is thus possible, advantageously, to achieve a particularly compact design of the portable power tool. It is thus possible, advantageously, to achieve precise guiding and fatigue-free handling of the portable power tool over a long period of time. In addition, advantageously, it is made possible to perform work on workpieces in locations that are not easily accessible. In addition, advantageously, convenient handling of the portable power tool can be achieved.

Furthermore, it is proposed that the maximum distance point, as viewed along the direction that is at least substantially perpendicular to the at least one workpiece contact surface, has a maximum distance of less than 120 mm in relation to the at least one workpiece contact surface. Preferably, the maximum distance of the maximum distance point in relation to the at least one workpiece contact surface, as viewed along the direction that is at least substantially perpendicular to the at least one workpiece contact surface, is less than 110 mm, and particularly preferably less than 100 mm. It is thereby possible, particularly advantageously, to realize a compact design of the portable power tool.

It is additionally proposed that the portable power tool have at least one center of gravity axis, which is at least substantially parallel to the at least one workpiece contact surface and which, as viewed along the direction that is at least substantially perpendicular to the at least one workpiece contact surface, has a maximum distance of less than 90 mm in relation to the maximum distance point. In particular, the center of gravity axis, as viewed along the direction that is at least substantially perpendicular to the at least one workpiece contact surface, has a maximum distance of less than 70 mm, preferably less than 50 mm, and particularly preferably less than 40 mm, relative to the maximum distance point. In the case of a design of the portable power tool as a battery-operated power tool, the center of gravity axis, as viewed along the distance that is at least substantially perpendicular to the at least one workpiece contact surface, has, very particularly preferably, a maximum distance having a value of between 40 mm and 50 mm relative to the maximum distance point. In the case of a design of the portable power tool as a power tool operated via a power cord, the center of gravity axis, as viewed along the direction that is at least substantially perpendicular to the at least one workpiece contact surface, has, very particularly preferably, a maximum distance having a value of between 32 mm and 45 mm relative to the maximum distance point. A "center of gravity axis" is to be understood here to mean, in particular, an axis that goes through the center of gravity of the portable power tool and that, in particular, is disposed in a plane that is at least substantially parallel to the at least one workpiece contact surface. "Substantially parallel" is to be understood here to mean, in particular, an alignment of a direction relative to a reference direction, in particular in one plane, the direction deviating with respect to the reference direction by, in particular, less than 30°, advantageously less than 15°, and particularly advantageously less than 10°. Particularly preferably, the center of gravity axis is parallel to the at least one workpiece contact surface. The design according to the disclosure makes it possible, advantageously, for the main handle to be disposed close to a center of gravity of the portable power tool. It is thereby possible, advantageously, to realize a short lever arm from the handle to the center of gravity. Torques that have to be supported by a user while performing work with the portable power tool are thus advantageously small. It is thus possible, advantageously, to achieve fatigue-free working with the portable power tool over a long period of time. Moreover, advantageously, it is possible to achieve particularly convenient use of the portable power tool, particularly if the main handle is designed as a bow-type handle, in respect of a working method for lateral working, in particular a method for working a lateral edge of a workpiece, a center of gravity of the portable power tool being disposed, advantageously, close to the main handle, in particular close to an operating element of an insertion depth setting unit of the portable power tool. Thus, owing to the design of the portable power tool according to the disclosure, only an advantageously small moment occurs, which can be supported on the main handle by an operator in the case of lateral working, in particular working of a lateral edge of a workpiece. In particular, the moment in this case is less than 2 Nm, preferably less than 1 Nm, particularly preferably less than 0.4 Nm, and very particularly preferably less than 0.35 Nm.

Furthermore, it is proposed that the portable power tool have at least the center of gravity axis, and at least one drive unit, which, as viewed along the direction that is at least substantially perpendicular to the at least one workpiece contact surface, is disposed, at least mostly, above the center of gravity axis. The expression "disposed, at least mostly, above the center of gravity axis" is to be understood here to mean, in particular, a disposition of an element and/or of a unit wherein, in particular, at least more than 60%, preferably more than 75%, and particularly preferably more than 90%, of a total volume of the element and/or of the unit, as viewed along a direction out from the at least one workpiece contact surface toward the main handle, is disposed above a notional plane in which the center of gravity axis extends. Thus, in particular, 60%, preferably more than 75%, and particularly preferably more than 90%, of a total volume of the drive unit, as viewed along the direction out from the at least one workpiece contact surface toward the main handle, is disposed above the notional plane in which the center of gravity axis extends. Particularly preferably, the drive unit is realized as an electric motor unit. It is also conceivable, however, for the drive unit to be of a different design, considered appropriate by persons skilled in the art, such as, for example, designed as an internal combustion motor unit, as a hybrid motor unit, or the like. In the case of the portable power tool being designed as a battery-operated power tool, the drive unit preferably has an output of at least 200 W, preferably an output of at least 240 W. In the case of the portable power tool being designed as a power tool operated via a power cord, the drive unit preferably has an output of at least 500 W, preferably an output of at least 800 W. Particularly advantageously, the design according to the disclosure enables a center of gravity of the portable power tool to be shifted toward the main handle. Thus, particularly preferably, a maximum distance of the main handle is small, in order to realize a short lever arm between the center of gravity and the main handle. It is thus possible, advantageously, to achieve particularly fatigue-free working with the portable power tool over a long period of time.

It is additionally proposed that the portable power tool comprise at least the drive unit, which has at least one drive axis, in particular a rotation axis of a rotor of the drive unit, which, as viewed along the direction that is at least substantially perpendicular to the at least one workpiece contact surface, has a minimum distance of greater than 45 mm in relation to the at least one workpiece contact surface. Preferably, the minimum distance of the drive axis in relation to the at least one workpiece contact surface is greater than 50 mm, and particularly preferably greater than 60 mm. In particular, the drive axis, as viewed along the direction that is at least substantially perpendicular to the at least one workpiece contact surface, has a maximum distance of less than 150 mm, preferably less than 130 mm, and particularly preferably less than 110 mm, in relation to the at least one workpiece contact surface. The design according to the disclosure makes it possible, by simple design means, for the drive unit to be disposed in a region close to the main handle.

It is additionally proposed that the portable power tool comprise at least the insert tool unit, and at least the drive unit for driving the insert tool unit, wherein the drive unit, as viewed along the direction that is at least substantially perpendicular to the at least one workpiece contact surface, is disposed mostly above the insert tool unit. The expression "disposed, at least mostly, above the insert tool unit" is to be understood here to mean, in particular, a disposition of an element and/or of a unit wherein, in particular, at least more than 60%, preferably more than 75%, and particularly preferably more than 90%, of a total volume of the element and/or of the unit, as viewed along a direction out from the at least one workpiece contact surface toward the main handle, is disposed above a notional plane that contacts or intersects the insert tool unit in a point that, as viewed along the direction that is at least substantially perpendicular to the at least one workpiece contact surface, has a maximum distance in relation to the at least one workpiece contact surface. Thus, in particular, more than 60%, preferably more than 75%, and particularly preferably more than 90%, of a total volume of the drive unit, as viewed along a direction out from the at least one workpiece contact surface toward the main handle, is disposed above the plane that contacts the insert tool unit in at least one point. Particularly preferably, the insert tool unit is realized as a planer blade unit. The design according to the disclosure makes it possible, by particularly simple design means, for the center of gravity of the portable power tool to be disposed in a region close to the main handle.

It is additionally proposed that the portable power tool comprise at least the insert tool unit, and at least the drive unit for driving the insert tool unit, wherein the drive unit, as viewed along the direction that is at least substantially perpendicular to the at least one workpiece contact surface, is disposed mostly above the insert tool unit. The expression "disposed, at least mostly, above the insert tool unit" is to be understood here to mean, in particular, a disposition of an element and/or of a unit wherein, in particular, at least more than 60%, preferably more than 75%, and particularly preferably more than 90%, of a total volume of the element and/or of the unit, as viewed along a direction out from the at least one workpiece contact surface toward the main handle, is disposed above a notional plane that contacts or intersects the insert tool unit in a point that, as viewed along the direction that is at least substantially perpendicular to the at least one workpiece contact surface, has a maximum distance in relation to the at least one workpiece contact surface. Thus, in particular, more than 60%, preferably more than 75%, and particularly preferably more than 90%, of a total volume of the drive unit, as viewed along a direction out from the at least one workpiece contact surface toward the main handle, is disposed above the plane that contacts the insert tool unit in at least one point. Particularly preferably, the insert tool unit is realized as a planer blade unit. The design according to the invention makes it possible, by particularly simple design means, for the center of gravity of the portable power tool to be disposed in a region close to the main handle.

Furthermore, it is proposed that the portable power tool comprise at least the drive unit having, at least, the drive axis, which intersects an axis of main extent of the main handle. Particularly preferably, the axis of main extent of the main handle is at least substantially parallel to the at least one workpiece contact surface. Preferably, the drive axis and the axis of main extent are disposed in a common plane, which extends at least substantially parallel to the at least one workpiece contact surface. By means of the design according to the disclosure, advantageously, a distance between the drive unit and the main handle, as viewed along the direction that is at least substantially perpendicular to the at least one workpiece contact surface, can be kept small. Thus, by simple design means, a center of gravity of the portable power tool can be disposed in a region close to the main handle, in order to achieve a compact design, and thus user-friendly handling, of the portable power tool.

It is additionally proposed that the portable power tool comprise at least the drive unit, which is realized as an EC motor unit. It is thereby possible, particularly advantageously, to positively influence a compact design of the portable power tool, without the necessity of accepting performance losses of the portable power tool. Thus, advantageously, a compact design and also a high-performance design of the portable power tool can be achieved at the same time.

It is additionally proposed that the portable power tool comprise at least the insert tool unit, and at least one workpiece debris discharge unit, which, as viewed along a direction that is at least substantially parallel to the at least one workpiece contact surface, is disposed in front of the insert tool unit, in particular as viewed along a direction that is contrary to a working direction of the portable power tool. A "workpiece debris discharge unit" is to be understood here to mean, in particular, a unit designed to convey workpiece particles that can be removed by means of the insert tool unit, following removal, out of a receiving region of the insert tool unit, in particular out of the power tool housing of the portable power tool, and/or to guide the removed workpiece particles as they are being conveyed out of the power tool housing. Preferably, the workpiece debris discharge unit is realized as a chip ejection unit. Preferably, at least a sub-region of the at least one movably mounted workpiece contact surface is realized as a chip guide stage of the workpiece debris discharge unit. Owing to the workpiece debris discharge unit being disposed, according to the disclosure, in front of the insert tool unit, a rotational energy of the insert tool unit can be used, advantageously, for removing, in particular for ejecting, workpiece debris. It is thus possible, advantageously, to avoid use of an additional fan. Moreover, advantageously, it is possible to achieve a space-saving disposition of the workpiece debris discharge unit on the portable power tool, since it is possible to dispense with long discharge channels. This, advantageously, has a positive effect on the compactness of the portable power tool.

Furthermore, it is proposed that the portable power tool comprise at least one energy storage receiving unit, which is disposed mostly in the main handle. In this case, preferably, the energy storage receiving unit is surrounded by at least one housing wall that constitutes the main handle, in particular is realized so as to be integral with this housing wall. Particularly preferably, the energy storage receiving unit is designed to receive an energy storage unit realized as a storage battery unit. The energy storage unit in this case can preferably be disposed in a detachable manner on the energy storage receiving unit. The expression "disposed mostly in the main handle" is to be understood here to mean, in particular, a disposition of an element and/or of a unit in the main handle wherein, in particular, at least more than 60%, preferably more than 75%, and particularly preferably more than 90%, of a total volume of the element and/or of the unit is disposed inside the main handle. The design according to the disclosure enables an energy storage to be disposed in an advantageous manner, enabling a compact design of the portable power tool according to the disclosure to be influenced in a particularly positive manner. Moreover, advantageously, an energy storage unit disposed on the energy storage receiving unit can be protected by being disposed in the main handle.

It is additionally proposed that the energy storage receiving unit have at least one energy storage guide element, which has a main extent that is at least substantially parallel to the at least one workpiece contact surface. Advantageously, a compact design of the portable power tool can be promoted, owing to an at least substantially parallel alignment of the energy storage guide element and the at least one workpiece contact surface. Moreover, advantageously, it is possible to realize an insertion movement of the energy storage unit along a disposition movement, in particular an insertion movement, that is at least substantially parallel to the at least one workpiece contact surface.

Additionally proposed is a power tool system, having at least one portable power tool according to the disclosure, and having at least the energy storage unit that, when having been disposed on the portable power tool, as viewed along the direction that is at least substantially perpendicular to the at least one workpiece contact surface, is disposed at least substantially entirely, in particular entirely, above the center of gravity axis of the portable power tool. The energy storage unit in this case, when having been disposed on the energy storage receiving unit, is preferably aligned such that it is at least substantially parallel to the center of gravity axis. Thus, advantageously, a compact design of the portable power tool can be achieved. Moreover, the energy storage unit can be used as a counterweight to the workpiece contact unit. Furthermore, it is proposed that the power tool system have a maximum total mass of less than 1.5 kg. The portable power tool in this case preferably has a maximum total individual mass of less than 1 kg. In particular, the energy storage unit has a maximum total individual mass of less than 0.5 kg. In the case of an alternative design of the portable power tool, as a power tool operated via a power cord, the portable power tool preferably has a maximum total mass of less than 2.5 kg. The design according to the disclosure makes it possible to achieve fatigue-free working with the portable power tool over a long period of time, since an operator is exposed only to small loads.

It is additionally proposed that the power tool system have a maximum longitudinal extent of less than 230 mm. It is thus possible, particularly advantageously, to realize a power tool system that is compact and easy to handle.

The portable power tool according to the disclosure and/or the power tool system according to the disclosure are/is not intended to be limited to the application and embodiment described above. In particular, the portable power tool according to the disclosure and/or the power tool system according to the disclosure may have individual elements, components and units that differ in number from a number stated herein, in order to fulfill a principle of function described herein. Moreover, in the case of the value ranges specified in this disclosure, values lying within the stated limits are also to be deemed as disclosed and applicable in any manner.

BRIEF DESCRIPTION OF THE DRAWINGS

Further advantages are disclosed by the following description of the drawings. The drawings show an exemplary embodiment of the disclosure. The drawings, the description and the claims contain numerous features in combination. Persons skilled in the art will also expediently consider the features individually and combine them to create appropriate further combinations.

There are shown in.

DETAILED DESCRIPTION

Figure 1:
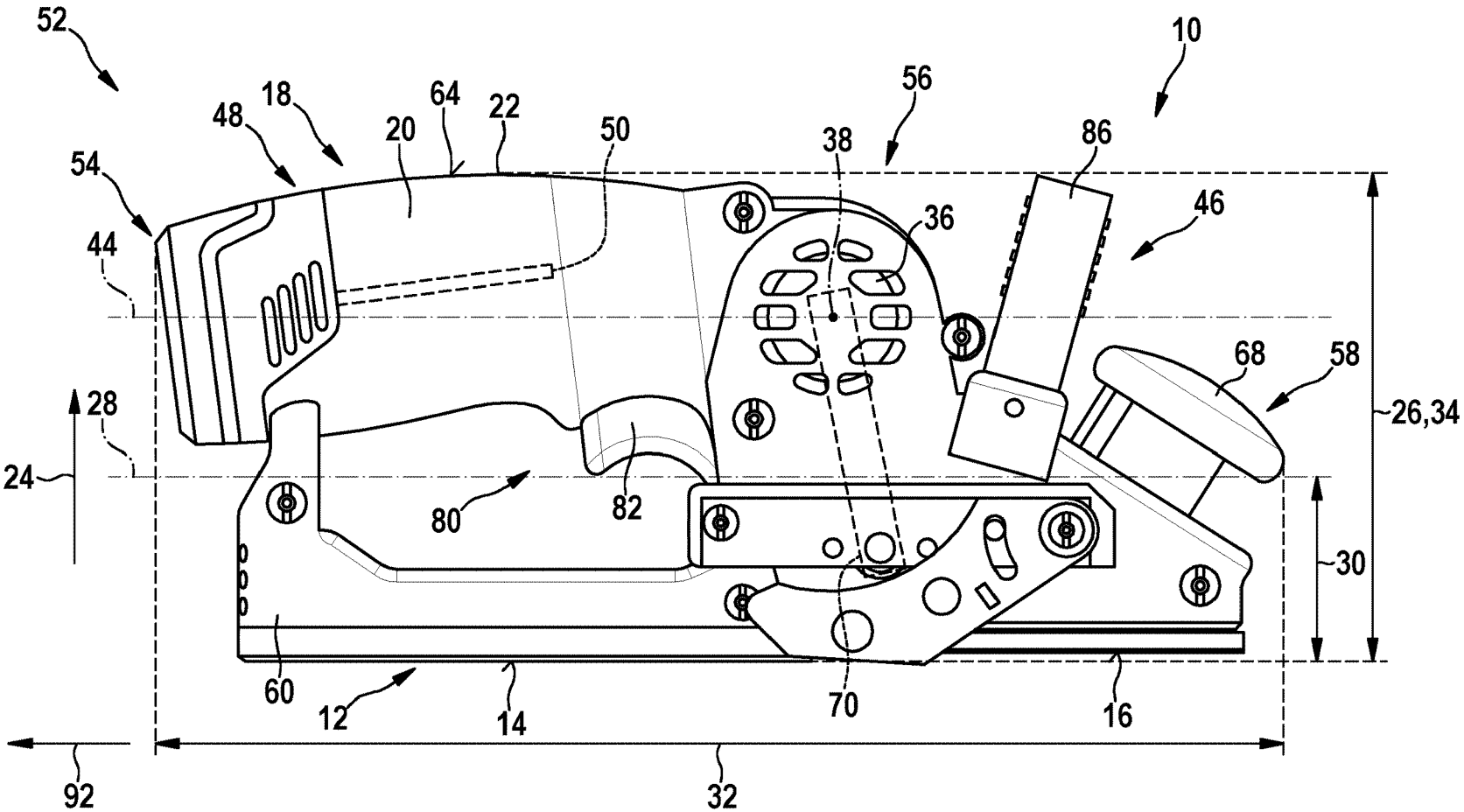
FIG. 1 a side view of a power tool system according to the disclosure, having a portable power tool according to the disclosure, and having an energy storage unit, in a schematic representation, FIG. 2 a top view of the power tool system according to the disclosure, in a schematic representation, and FIG. 3 a sectional view of the portable power tool according to the disclosure, in a schematic representation.

FIG. 1 shows a power tool system 52, having at least one portable power tool 10, and having at least one energy storage unit 54. The power tool system 52 has a maximum total mass of less than 1.5 kg. The portable power tool 10 in this case has a maximum total individual mass of less than 1 kg. The energy storage unit 54 has a maximum total individual mass of less than 0.5 kg. The energy storage unit 54 in this case is realized as a storage battery unit. In addition, the energy storage unit 54 can be removably disposed on the portable power tool 10. For this purpose, the portable power tool 10 comprises at least one energy storage receiving unit 48, by means of which the energy storage unit 54 can be disposed and/or fixed on the portable power tool 10, in a manner already known to persons skilled in the art. The energy storage unit 54, when having been disposed on the portable power tool 10, as viewed along a direction 24 that is at least substantially, in particular entirely, perpendicular to a workpiece contact surface 14 of a workpiece contact unit 12, of the portable power tool 10, is disposed at least substantially entirely above a center of gravity axis 28 of the portable power tool 10. The portable power tool 10 is thus realized as a battery-operated portable power tool. It is also conceivable, however, for the portable power tool 10 to be realized, in an alternative design, not represented in greater detail here, as a portable power tool operated via a power cord.

The portable power tool 10 is realized as a hand-held power planer. The portable power tool 10 thus comprises at least the workpiece contact unit 12, which has at least the workpiece contact surface 14, and at least one handle unit 18, which has at least one main handle 20.

The workpiece contact unit 12 comprises in total at least two workpiece contact surfaces 14, 16. The workpiece contact surfaces 14, 16 are at least substantially, in particular entirely, parallel to each other. It is also conceivable, however, for the workpiece contact unit 12 to have a number of workpiece contact surfaces 14, 16 other than two. One of the workpiece contact surfaces 14, 16 in this case is movably mounted on a power tool housing 56 of the portable power tool 10. The other of the workpiece contact surfaces 14, 16 is disposed in a fixed manner on the power tool housing 56. In this case, the workpiece contact surface 14 disposed in a fixed manner on the power tool housing 56 is constituted by a base plate element of the workpiece contact unit 12. The workpiece contact surface 16 that is movably mounted on the power tool housing 56 is constituted by a further base plate element of the workpiece contact unit 12. A position of the workpiece contact surface 16 that is movably mounted on the power tool housing 56 can be set relative to the power tool housing 56 by means of an insertion depth setting unit 58 of the portable power tool 10, in a manner already known to persons skilled in the art. The insertion depth setting unit 58 is thus designed, in a manner already known to persons skilled in the art, to set an insertion depth, in particular a planing depth, of an insert tool unit 42 of the portable power tool 10. For the purpose of setting an insertion depth, the insertion depth setting unit 58 comprises at least one insertion depth operating element 68. The insertion depth operating element 68 is rotatably mounted on the power tool housing 56. The insertion depth operating element 68 additionally constitutes a further support surface for a hand of an operator, for the purpose of guiding the portable power tool 10, in a manner already known to persons skilled in the art.

The portable power tool 10 additionally comprises at least one operating unit 80, which is designed to open and/or close an electric circuit as a result of being actuated by an operator. The operating unit 80 has at least one operating element 82. The operating element 82 is disposed on the main handle 20. The operating element 82 in this case is movably mounted on the main handle 20. The operating element 82 is mounted in a translationally movable manner on the main handle 20. It is also conceivable for the operating element 82 to be pivotally mounted on the main handle 20. The operating element 82 is designed, in a manner already known to persons skilled in the art, to actuate an electric switch element 66 (FIG. 3) of the portable power tool 10.

Further, the portable power tool 10 has a maximum longitudinal extent 32 and a maximum height extent 34, a ratio of the maximum longitudinal extent 32 to the maximum height extent 34 being less than 2.5. The maximum longitudinal extent 32 is at least substantially, in particular entirely, parallel to at least one of the workpiece contact surfaces 14, 16, and at least substantially, in particular entirely, perpendicular to a rotation axis 76 of the insert tool unit 42 of the portable power tool 10. The maximum height extent 34 is at least substantially, in particular entirely, perpendicular to at least one of the workpiece contact surfaces 14, 16. The portable power tool 10 additionally has a maximum width extent 78 (FIG. 2), which is at least substantially, in particular entirely, parallel to at least one of the workpiece contact surfaces 14, 16, and at least substantially, in particular entirely, parallel to the rotation axis 76 of the insert tool unit 42. In this case, a ratio of the maximum longitudinal extent 32 to the maximum width extent 78 is less than 2.5.

Figure 2:
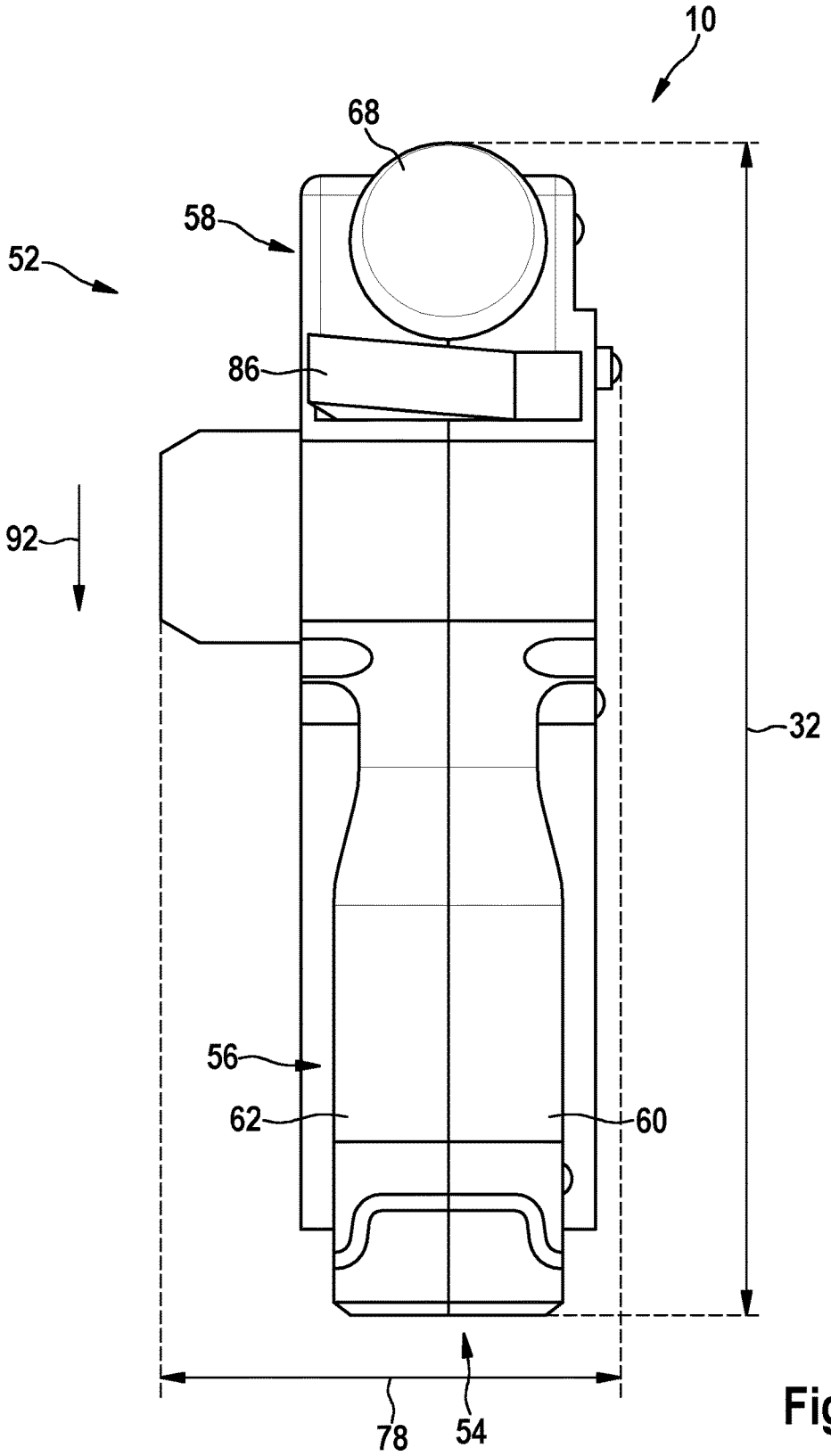

The power tool housing 56 additionally comprises at least two housing shell elements 60, 62, which are connected to each other (FIG. 2). The housing shell elements 60, 62 in this case are fixed to each other by means of fastening elements, in particular screws. The power tool housing 56 is thus of a half-shell design. It is also conceivable, however, for the power tool housing 56 to be of a different design, considered appropriate by persons skilled in the art, such as, for example, a cup-type design, or a combination of a cup-type and a shell-type design, or the like. The power tool housing 56 is made of a plastic. In particular, all components of the portable power tool 10 are disposed directly in the housing shell elements 60, 62. Thus, all bearing seats or receivers for the components of the portable power tool 10 are constituted by the housing shell elements 60, 62. In particular, apart from bearing elements such as, for example, rolling bearings or slide bearings, it is advantageously possible to dispense with additional metallic elements for seating and/or receiving the individual components.

The housing bearing elements 60, 62, when having been fixed to each other, constitute a main handle 20. Each of the housing shell elements 60, 62 preferably constitutes one half of the main handle 20. In this case, the energy storage receiving unit 48 is disposed mostly in the main handle 20. Preferably, the energy storage receiving unit 48 is disposed entirely in the main handle 20. The energy storage receiving unit 48 has at least one energy storage guide element 50, which has a main extent that is at least substantially, in particular entirely, parallel to the workpiece contact surfaces 14, 16. The energy storage guide element 50 in this case is disposed on a side of one of the housing shell elements 60, 62 that faces away from a gripping surface 64 of the main handle 20, the side that faces away being constituted by an inner wall of one of the housing shell elements 60, 62. The energy storage guide element 50 is of a rib-type design. It is also conceivable, however, for the energy storage guide element 50 to be of a different design, considered appropriate by persons skilled in the art, such as, for example, a groove type design or the like. The energy storage receiving unit 48 has in total at least two energy storage guide elements 50 (in FIG. 1, only one of the energy storage guide elements 50 is represented, by a broken line). It is also conceivable, however, for the energy storage receiving unit 48 to have a number of energy storage guide elements 50 other than two. The energy storage guide elements 50 are of an at least substantially similar design. In this case, each one of the energy storage guide elements 50 is disposed, respectively, on an inner wall of one of the housing shell elements 60, 62. Thus, when the housing shell elements 60, 62 have been fixed to each other, the energy storage guide elements 50 are disposed on two inner sides of the power tool housing 56 that face toward each other. The energy storage guide elements 50 are at least substantially, in particular entirely, parallel to each other. The energy storage receiving unit 48 in this case is disposed on a side of the power tool housing 56 that faces away from the workpiece contact unit 12. The main handle 20 is thus likewise disposed on a side of the power tool housing 56 that faces away from the workpiece contact unit 12.

The main handle 20 has at least one maximum distance point 22 that, as viewed along a direction 24 that is at least substantially, in particular entirely, perpendicular to at least one of the workpiece contact surfaces 14, 16, has a maximum distance 26 of less than 150 mm in relation to at least one of the workpiece contact surfaces 14, 16. The maximum distance point 22 in this case is disposed on a side of the gripping surface 64 of the main handle 20 that faces away from the workpiece contact unit 12. Preferably, the maximum distance point 22 has, in particular, as viewed along the direction 24 that is at least substantially perpendicular to at least one of the workpiece contact surfaces 14, 16, a maximum distance 26 of less than 120 mm in relation to at least one of the workpiece contact surfaces 14, 16. In particular, when the movably mounted workpiece contact surface 16 is in a fully retracted state, in which the movably mounted workpiece contact surface 16 is in contact with a stop of the power tool housing 56, the maximum distance point 22 has a maximum distance 26 of less than 120 mm relative to the movably mounted workpiece contact surface 16.

Furthermore, the portable power tool 10 has at least one center of gravity axis 28, which is at least substantially, in particular entirely, parallel to at least one of the workpiece contact surfaces 14, 16, and which, as viewed along the direction 24 that is at least substantially perpendicular to at least one of the workpiece contact surfaces 14, 16, has a maximum distance 30 of less than 90 mm in relation to the workpiece contact surfaces 14, 16. The center of gravity axis 28 in this case has a maximum distance 30 of less than 60 mm, in particular less than 50 mm, in relation to at least one of the workpiece contact surfaces 14, 16. Moreover, the center of gravity axis 28 is at least substantially, in particular entirely, parallel to at least one of the workpiece contact surfaces 14, 16.

Figure 3:
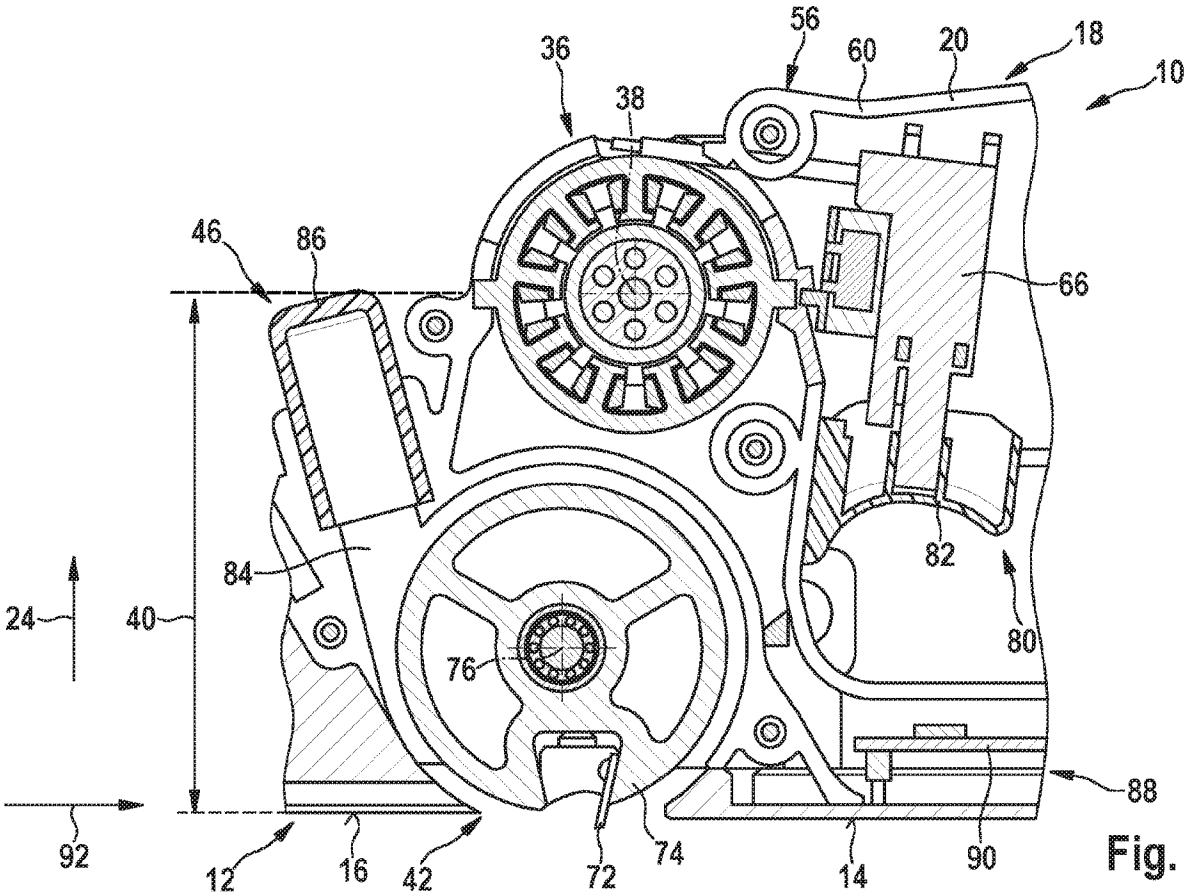

Furthermore, the portable power tool 10 has at least one drive unit 36 that, as viewed along the direction 24 that is at least substantially perpendicular to at least one of the workpiece contact surfaces 14, 16, is at least mostly disposed above the center of gravity axis 28 (FIG. 3). In this case, at least 60% of a total volume of the drive unit 36 is disposed above the center of gravity axis 28. In a particularly preferred design of the portable power tool 10, the drive unit 36 is disposed entirely above the center of gravity axis 28. The drive unit 36 is realized as an EC motor unit. It is also conceivable, however, for the drive unit 36 to be of a different design, considered appropriate by persons skilled in the art, in particular, in the case of an alternative design of the portable power tool 10, as a portable power tool operated via a power cord. The drive unit 36 has at least one drive axis 38 that, as viewed along the direction 24 that is at least substantially perpendicular to at least one of the workpiece contact surfaces 14, 16, has a minimum distance 40 of greater than 45 mm in relation to at least one of the workpiece contact surfaces 14, 16 (FIG. 3). The drive axis 38 in this case is at least substantially, in particular entirely, parallel to at least one of the workpiece contact surfaces 14, 16. In addition, the drive axis 38 intersects an axis of main extent 44 of the main handle 20. The axis of main extent 44 of the main handle 20 is substantially, in particular entirely, parallel to at least one of the workpiece contact surfaces 14, 16. It is also conceivable, however, for the drive axis 38 to have a parallel offset, of less than 10 mm, or to be skewed in relation to the axis of main extent 44 of the main handle 20.

The drive unit 36 is designed to drive the insert tool unit 42 of the portable power tool 10. The portable power tool 10 in this case has at least one output unit 70, by means of which the drive unit 36 is operatively connected to the insert tool unit 42, in a manner already known to persons skilled in the art. The output unit 70 comprises at least one driving-force transmission element (not represented in greater detail here) for transmitting driving forces and/or driving torques from the drive unit 36 to the insert tool unit 42. The driving-force transmission element is realized as a drive belt, in particular as a toothed belt. It is also conceivable, however, for the driving-force transmission element to be of a different design, considered appropriate by persons skilled in the art, such as, for example, designed as a toothed wheel or the like. The insert tool unit 42 is realized as a planer blade unit. The insert tool unit 42 in this case has at least one cutting element 72 for removing workpiece particles of a workpiece on which work is to be performed (not represented in greater detail here). It is also conceivable, however, for the insert tool unit 42 to have more than one cutting element 72. The cutting element 72 is realized as a planer blade. In addition, the cutting element 72 is disposed on a rotational element 74 of the insert tool unit 42, in a manner known to persons skilled in the art. The rotational element 74 is realized as a planer shaft. The rotational element 74 is thus rotatably mounted in the power tool housing 56, in particular in the two housing shell elements 60, 62. A rotation axis 76 of the insert tool unit 42, in particular of the rotational element 74, is at least substantially, in particular entirely, parallel to at least one of the workpiece contact surfaces 14, 16. In addition, the rotation axis 76 of the insert tool unit 42 is at least substantially, in particular entirely, parallel to the drive axis 38 of the drive unit 36.

Furthermore, the portable power tool 10 has at least one insert tool unit 42, the drive unit 36, as viewed along the direction 24 that is at least substantially perpendicular to at least one of the workpiece contact surfaces 14 16, being mostly disposed above the insert tool unit 42. The drive unit 36 in this case is disposed entirely above the insert tool unit 42. The insert tool unit 42 and the drive unit 36 in this case, as viewed along the direction 24 that is at least substantially perpendicular to at least one of the workpiece contact surfaces 14 16, have a minimum distance of greater than 1 mm, in particular greater than 10 mm, in relation to each other.

Further, the portable power tool 10 comprises at least one workpiece debris discharge unit 46, which is disposed in front of the insert tool unit 42 as viewed along the direction 92 that is at least substantially, in particular entirely, parallel to at least one of the workpiece contact surfaces 14, 16. The workpiece debris discharge unit 46 is disposed in front of the insert tool unit 42 as viewed along a direction that is contrary to a working direction of the portable power tool 10 and along which the portable power tool 10 can be moved for the purpose of performing work on a workpiece. The workpiece debris discharge unit 46 in this case is designed to convey workpiece particles removed by means of the insert tool unit 42, following removal, out of an insert tool rotation region of the power tool housing 56 and out of the power tool housing itself 56. Workpiece particles are conveyed by the workpiece debris discharge unit 46 by means of a rotational energy of the insert tool unit 42.

For the purpose of outputting workpiece particles from the power tool housing 56, the workpiece debris discharge unit 46 comprises at least one discharge channel 84, which connects a side of the power tool housing 56 that faces away from the workpiece contact unit 12 to the insert tool rotation region. The discharge channel 84 in this case is designed to deflect workpiece particles, which are removed from a workpiece by means of the insert tool unit 42, in such a manner that the workpiece particles can be conveyed out of the power tool housing 56. Starting from the insert tool rotation region, the discharge channel 84 in this case extends at least substantially transversely in relation to at least one of the workpiece contact surfaces 14, 16. The workpiece debris discharge unit 46 may also comprise more than one discharge channel 84 for conveying removed workpiece particles out of the power tool housing 56. The workpiece debris discharge unit 46 may also comprise a flap unit, by means of which an operator can deflect removed workpiece particles into the differing discharge channels 84 of the workpiece debris discharge unit 46. By means of the flap unit, it is thus possible to set, for example, the side of the power tool housing 56 on which removed workpiece particles can be conveyed out of the power tool housing 56 by means of the workpiece debris discharge unit 46. The workpiece debris discharge unit 46 additionally has at least one suction extraction connecting element 86, which can be connected to an external suction extraction unit (not represented in greater detail here). The suction extraction connecting element 86 is directly connected to the discharge channel 84. The suction extraction connecting element 86 in this case may be realized so as to be integral with the power tool housing 56, or realized separately from the power tool housing 56, the suction extraction connecting element 86 being detachably connectable to the discharge channel 84. The suction extraction connecting element 86, in particular when having been connected to the discharge channel 84, extends at least substantially transversely in relation to at least one of the workpiece contact surfaces 14, 16. It is additionally conceivable for the suction extraction connecting element 86 to be movably mounted on the power tool housing 56. Further, it is conceivable that a cooling airflow of a cooling unit of the drive unit 36 can be used to support discharge of removed workpiece particles through the discharge channel 84.

Furthermore, the portable power tool 10 has at least one open-loop and/or closed-loop control unit 88. The open-loop and/or closed-loop control unit 88 in this case has at least one main circuit board 90, which is operatively connected to the switch element 66, which can be actuated by means of the operating element 82, and to the drive unit 36. The open-loop and/or closed-loop control unit 88 thus preferably constitutes a power electronics unit of the portable power tool 10. The main circuit board 90 has an axis of main extent that is at least substantially, in particular entirely, parallel to at least one of the workpiece contact surfaces 14, 16. The main circuit board 90 in this case, as viewed along the direction 24 that is at least substantially perpendicular to at least one of the workpiece contact surfaces 14, 16, is disposed between the center of gravity axis 28 and the workpiece contact unit 12, in the power tool housing 56.

For the purpose of cooling the open-loop and/or closed-loop control unit 88, at least one cooling air channel of the cooling unit of the drive unit 36 goes from the drive unit 36, through the power tool housing 56, to the open-loop and/or closed-loop control unit 88. The open-loop and/or closed-loop control unit 88 in this case is disposed in the power tool housing 56, on a side of the power tool housing 56 that faces away from the insertion depth setting unit 58. In this case, air inlet openings of the cooling unit are disposed on a side of the power tool housing 56 that faces away from the workpiece contact unit 12, in particular in a transition region from the main handle 20 to a sub-region of the power tool housing 56, in which the drive unit 36 is mounted. Further, air outlet openings of the cooling unit are disposed on the side of the power tool housing 56 that faces away from the insertion depth setting unit 58. The cooling air channel preferably goes through the main handle 20, to the air outlet openings of the cooling unit. The cooling air channel extends from the air inlet openings, past the drive unit 36, in particular around the latter, through the main handle 20 and past the open-loop and/or closed-loop control unit 88, in particular around the latter, to the air outlet openings. By means of the cooling unit, which is realized, in particular, as a fan unit, cooling air can thus be sucked in through the air inlet openings and routed, through the cooling air channel, to the air outlet openings, at which the cooling air, heated by the waste heat of the drive unit 36 and of the open-loop and/or closed-loop control unit 88, emerges again from the power tool housing 56. The open-loop and/or closed-loop control unit 88 can thus be actively cooled by means of the cooling unit of the drive unit 36.

The invention claimed is:

1. A power tool system, comprising:

at least one portable power tool including:

at least one workpiece contact unit having at least one workpiece contact surface, at least one power driven drive unit having at least one drive axis, and at least one handle unit having at least one main handle, wherein the main handle has at least one maximum distance point that, as viewed along a direction that is at least substantially perpendicular to the at least one workpiece contact surface, has a maximum distance of less than 150 mm in relation to the at least one workpiece contact surface; and at least one energy storage unit configured to store power and configured such that, when arranged on the portable power tool, as viewed along the direction that is at least substantially perpendicular to the at least one workpiece contact surface, is disposed at least substantially entirely above a center of gravity axis of the portable power tool, wherein the at least one drive axis is coplanar with and intersects an axis of a main extent of the at least one main handle, and the at least one drive axis is located forwardly of the at least one main handle and above the at least one workpiece contact surface.

2. The power tool system as claimed in claim 1, wherein the power tool system has a maximum total mass of less than 1.5 kg.

3. The power tool system as claimed in claim 1, wherein the power tool system has a maximum longitudinal extent of less than 230 mm.

4. The power tool system of claim 1, wherein the axis of the main extent of the at least one main handle is parallel to the at least one workpiece contact surface.

5. A portable power tool, comprising:

at least one workpiece contact unit having at least one workpiece contact surface;

at least one handle unit having at least one main handle, wherein the main handle has at least one maximum distance point that, as viewed along a direction that is at least substantially perpendicular to the at least one workpiece contact surface, has a maximum distance of less than 150 mm in relation to the at least one workpiece contact surface; and at least one power driven drive unit having at least one drive axis, the at least one drive axis coplanar with and intersecting an axis of a main extent of the main handle, wherein the at least one drive axis is located forwardly of the main handle and above the at least one workpiece contact surface.

6. The portable power tool as claimed in claim 5, wherein the maximum distance point, as viewed along the direction that is at least substantially perpendicular to the at least one workpiece contact surface, has the maximum distance of less than 120 mm in relation to the at least one workpiece contact surface.

7. The portable power tool as claimed in claim 5, further comprising at least one center of gravity axis, which is at least substantially parallel to the at least one workpiece contact surface and which, as viewed along the direction that is at least substantially perpendicular to the at least one workpiece contact surface, has a maximum distance of less than 90 mm in relation to the at least one workpiece contact surface.

8. The portable power tool as claimed in claim 5, including a center of gravity axis, wherein the at least one drive unit, which, as viewed along the direction that is at least substantially perpendicular to the at least one workpiece contact surface, is disposed, at least mostly, above the center of gravity axis.

9. The portable power tool as claimed in claim 5, wherein the at least one drive axis, which, as viewed along the direction that is at least substantially perpendicular to the at least one workpiece contact surface, has a minimum distance of greater than 45 mm in relation to the at least one workpiece contact surface.

10. The portable power tool as claimed in claim 5, further comprising an insert tool unit, wherein the at least one drive unit, as viewed along the direction that is at least substantially perpendicular to the at least one workpiece contact surface, is disposed mostly above the insert tool unit.

11. The portable power tool as claimed in claim 5, wherein the at least one drive unit is configured as an EC motor unit.

12. The portable power tool as claimed in claim 5, further comprising one or more of at least one open-loop and closed-loop control unit, which, as viewed along the direction that is at least substantially perpendicular to the at least one workpiece contact surface, is disposed between a center of gravity axis of the power tool and the workpiece contact unit.

13. The portable power tool as claimed in claim 5, further comprising at least one insert tool unit, and at least one workpiece debris discharge unit, which, as viewed along a direction that is at least substantially parallel to the at least one workpiece contact surface, is disposed completely in front of an axis of rotation of the insert tool unit.

14. The portable power tool as claimed in claim 5, further comprising at least one energy storage receiving unit disposed mostly in the main handle.

15. The portable power tool as claimed in claim 14, wherein the energy storage receiving unit has at least one energy storage guide element, the energy storage guide element having a main extent that is at least substantially parallel to the at least one workpiece contact surface.

16. The portable power tool as claimed in claim 5, wherein the portable power tool is configured as a hand-held power planer.

17. The portable power tool as claimed in claim 5, wherein the axis of the main extent of the main handle is parallel to the at least one workpiece contact surface.

18. The portable power tool as claimed in claim 5, further comprising:

an operating element configured to actuate a switch, the operating element located directly above the at least one workpiece contact surface and at least in part directly beneath the main handle.

19. The portable power tool as claimed in claim 5, wherein the at least one drive axis and the axis of the main extent of the main handle are parallel to the at least one workpiece contact surface.

* * * * *